US007594838B2

(12) United States Patent
Vladimirov et al.

(10) Patent No.: US 7,594,838 B2
(45) Date of Patent: Sep. 29, 2009

(54) METHOD OF INTRODUCING MERCURY INTO AN ELECTRON LAMP

(76) Inventors: Oleksandr V. Vladimirov, ul. Molodezhnaya, 34-60, Rivne-Kvasilov 35350 (UA); Mykola I. Kalytynskyy, ul. Verbova, 45-128, Rivne, 33024 (UA)

( * ) Notice: Subject to any disclaimer, the term of this patent is extended or adjusted under 35 U.S.C. 154(b) by 445 days.

(21) Appl. No.: 10/534,071

(22) PCT Filed: Nov. 8, 2002

(86) PCT No.: PCT/UA02/00062

§ 371 (c)(1),
(2), (4) Date: Aug. 1, 2005

(87) PCT Pub. No.: WO2004/042776

PCT Pub. Date: May 21, 2004

(65) Prior Publication Data

US 2006/0154553 A1 Jul. 13, 2006

(51) Int. Cl.
*H01J 9/38* (2006.01)
*H01J 61/28* (2006.01)
*H01J 61/00* (2006.01)

(52) U.S. Cl. ..... 445/9; 445/26; 313/564; 313/565; 313/566

(58) Field of Classification Search ..... 445/38, 445/9; 313/546, 490, 564–566
See application file for complete search history.

(56) References Cited

U.S. PATENT DOCUMENTS 2,415,895 A * 2/1947 Lopez ..... 313/546
3,983,439 A * 9/1976 Blommerde et al. ..... 313/565
4,056,750 A * 11/1977 Latassa ..... 313/546
4,182,971 A * 1/1980 Cassidy et al. ..... 313/546
4,335,326 A * 6/1982 Latassa et al. ..... 313/546
4,754,193 A * 6/1988 Holmes et al. ..... 313/490
4,907,998 A * 3/1990 Kuijer et al. ..... 445/9

(Continued)

FOREIGN PATENT DOCUMENTS

JP 2001023567 A * 1/2001

*Primary Examiner*—Sikha Roy
(74) *Attorney, Agent, or Firm*—Weiner & Burt, P.C.; Irving M. Weiner; Pamela S. Burt

(57) ABSTRACT

The invention relates to methods of manufacturing gas-discharge electron lamps, and neon tubes in particular. According to the invention, it is proposed, prior to carrying out vacuum treatment of the internal space of an electron lamp (1), to mount at least one of said glass capsules (2) in exhaust tube (5), in close proximity to an exposed electrode in such manner that the opening provided in metal container (4) is facing the working area of the lamp (1). Upon carrying out vacuum treatment and filling the internal space with an inert gas, the portion of exhaust tube (5) that contains capsule (2) disposed within metal container (4) is separated from evacuation unit (10), and this area is subjected to the local effect of a high-power electromagnetic radiation, thereby causing substantially instantaneous heating of metal container (4), which results in a rupture of glass capsule (2) and intense evaporation of the liquid mercury, thereby resulting in a directional flow of pure mercury vapor, which flow rapidly fills up said internal space of the tube through the opening provided in metal container (4). Such method permits to provide environmentally safe production and to eliminate contamination of mercury inside the working space of a lamp, which in turn allows carrying out precise dosing and introduction of calculated minimal amounts of mercury. In addition, the inventive method does not require application of special electrodes and might be used in any mass manufacture of commercial products, and neon tubes in particular.

5 Claims, 1 Drawing Sheet

U.S. PATENT DOCUMENTS 5,374,871 A * 12/1994 Johnson ..... 313/546
5,917,276 A * 6/1999 Traksel et al. ..... 313/490
6,034,485 A * 3/2000 Parra ..... 315/209 R
6,680,571 B1 * 1/2004 Giorgi et al. ..... 313/565

* cited by examiner

METHOD OF INTRODUCING MERCURY INTO AN ELECTRON LAMP

FIELD OF THE INVENTION

The invention relates to methods of introducing mercury into electron lamps, and preferably relates to methods of a dosed introduction of mercury into electron lamps, and neon tubes in particular, with the use of glass capsules containing liquid mercury and disposed within a metal container.

BACKGROUND OF THE INVENTION

It is a well-known fact that mercury is necessary in manufacturing practically all kinds of gas-discharge lamps, e.g. mercury rectifiers, lasers, and fluorescent tubes. Fluorescent tubes are made as glass tubes whose internal surfaces are covered with fluorescent materials. The tubes are filled up with an inert gas, e.g. argon or neon, together with a minimal amount of mercury vapor. Mercury constitutes the major ingredient that ensures functioning of such tubes. However, high toxicity of mercury creates serious environmental problems both in the manufacture of such tubes and in dismantling of mercury-containing devices either upon expiration of their service life or in case of a failure thereof.

Ever increasing annual production, as well as steady growth of the range of tubes produced e.g. for such sector as neon industry, have required to impose certain restrictions on mercury application, and to establish minimum admissible amounts of mercury, compatible with the requirement to the functioning of such tubes. At present, a legal framework is being prepared in many countries with the aim of introducing international regulations on the use of mercury, establishing minimum admissible amounts of mercury for each product.

In the past, a rather widespread method consisted in introducing mercury through an exhaust tube into the working area of a tube. Open use of liquid mercury however entails a number of problems. Firstly, certain complexities during liquid mercury storage and transportation are inevitable due to a high pressure of its vapor at room temperature. Secondly, the main disadvantage of introducing liquid mercury prior to vacuum treatment of a lamp (tube) consists in the ingress of mercury into the equipment in the process of evacuation, thereby resulting in release of vapor into the environment. Thirdly, in case of introducing liquid mercury, its precise dosing is practically impossible. Generally, mercury is supplied into a lamp in considerably bigger amounts than calculated ones. This is caused by the fact that due to indirect heating, the liquid mercury contained within the lamp is exposed to surface oxidation and gets combined with materials from which an electrode is made; therefore, in practice only about 40% of the total amount of mercury introduced into the lamp may be used. In other words, in addition to environmental problems, such method results in an excessive consumption of mercury and does not permit to ensure accurate and reproducible dosing.

With the aim of overcoming the above drawbacks, prior art solutions have offered alternative technologies based e.g. on the use of soldered capsules containing certain amounts of liquid mercury.

Such capsules, being preferably of cylindrical shape, were mounted within the working space of a tube, following which evacuation was carried out, and mercury was released into the internal volume of the tube e.g. due to thermal effect.

Thus, U.S. Pat. No. 4,182,971 discloses the use of glass capsules that contain mercury and are fastened on an auxiliary electrode inside the tube working area. A capsule was heated by high-frequency effect, thereby resulting in glass cracking and hence the release of mercury vapor. Due to the long duration of the heating effect, such technology inevitably results in mercury oxidation and therefore its excessive consumption. In addition, implementation of this known method requires special electrodes of a rather complicated design.

To prevent possible complete destruction of a capsule and ingress of glass fragments into the internal space of a lamp, U.S. Pat. No. 4,335,326 proposes to place the capsule within the tube, inside a protective shield made of glass or metal. It is obvious that mounting of such capsules within the working area is rather complicated, and the process of operation does not exclude a damage to the internal structure of the tube.

SUMMARY OF THE INVENTION

The object of the invention consists in providing a method of introducing mercury into the internal space of an electron lamp, in which due to substantially instantaneous formation of a directional flow of mercury vapor, developed outside the working area of the tube, it would be possible to exclude contamination of mercury, and thereby to ensure precise dosing and the possibility of introduction calculated minimal amounts of mercury. In addition, the inventive method does not require application of special electrodes and could be used in any mass manufacture of commercial products, which fact is particularly promising when solving environmental problems and ensuring a precise dosing in the manufacture of fluorescent lamps and in particular neon tubes.

The object set forth is attained by that in a method of introducing mercury into the internal space of an electron lamp with the use of glass capsules containing liquid mercury and disposed each inside a metal container, one end of said container being provided with at least one opening whose diameter is much less than the diameter of a glass capsule, according to the invention prior to vacuum treatment at least one of said glass capsules is mounted in an exhaust tube of the exposed electrode in such manner that the opening provided in the metal container is facing the working area of the tube. Upon carrying out vacuum treatment and filling the internal space with an inert gas, the portion of the exhaust tube that contains the capsule is separated from an evacuation unit, and this area is subjected to the local effect of a high-power electromagnetic radiation. Such impact causes substantially instantaneous heating of the metal container, which results in a rupture of the glass capsule and intense evaporation of the liquid mercury, thereby resulting in a directional flow of pure mercury vapor, which flow rapidly fills up said internal space of the lamp through the opening in the metal container. The inventive process is completed by separation of the remaining portion of said exhaust tube with said metal container from said electron tube, thereby resulting in that the metal container contaminated with mercury vapor gets sealed inside the glass shell.

Such embodiment of the inventive method permits to create a source of mercury vapor outside the working area of the lamp and to provide practically instantaneous ingress of pure mercury vapor into the working area rather than using a long-term heating of mercury and producing partially oxidized mercury vapor as a result of supplying high-rating current to the tube electrodes, thereby causing the need to introduce excessive amounts of mercury. The inventive method is environmentally safe since even upon completion of the process of introduction the metal container contaminated with mercury vapor, together with remains of the destroyed glass capsule, is still in the sealed condition. Such arrangement ensures safe storage and transportation of mercury waste, e.g. to the location of its subsequent demercuration. In addition, due to the fact that mercury vapor rather than liquid mercury is supplied into a lamp, the time of electron lamps training is substantially reduced. The inventive method does not require development of any special additional electrodes, and may be therefore widely applied in the mass production of lamps using standard electrodes, and neon tubes in particular.

According to the present invention, it is preferable to make use of capsules containing liquid mercury in amounts within the range from about 2.5 mg to about 35 mg, followed by controlled introduction of such doses e.g. into standard fluorescent lamps.

The lower limit of this selected range is restricted by process capabilities during manufacture of such capsules, while the use of capsules containing more than 35 mg mercury requires an increase in the length of exhaust tubes, which is inexpedient.

It is also expedient to make use of the vacuum method for filling the capsules with mercury, said method allowing the internal space of the capsule to be completely filled with liquid mercury, to eliminate the possibility of mercury oxidation inside the capsule, and to avoid undesirable consequences of air ingress into the tube working area.

In another preferred embodiment of the inventive method, it is expedient to provide a local electromagnetic radiation by means of a high-frequency induction heating unit having a power rating within the range from about 500 W to about 1 kW. The selected power range permits to attain the required level of electromagnetic radiation in a minimal time period, e.g. 1 to 5 seconds, and does not cause any damage to the attending personnel.

According to still another embodiment of the invention, another object set forth may be solved in the most efficient way through the introduction of a metered amount of mercury into the internal space of neon tubes in compliance with the inventive method. This embodiment of the inventive method permits to ensure environmentally safe method of introducing precisely metered amounts of mercury in neon tubes of various configurations, said amounts being preferably within the range of from about 2.5 mg to about 35 mg. Due to the fact that mercury is introduced into the working space of neon tubes in the form of pure vapor, the probability of damage and blackening of the fluorescent layer decreases, thereby resulting in increased service life of such tubes.

BRIEF DESCRIPTION OF DRAWINGS

Now the invention will be further explained in more detail by means of specific Examples of embodiments thereof with reference to the accompanying drawings, in which.

PREFERRED EMBODIMENT OF THE INVENTION

Figure 1:
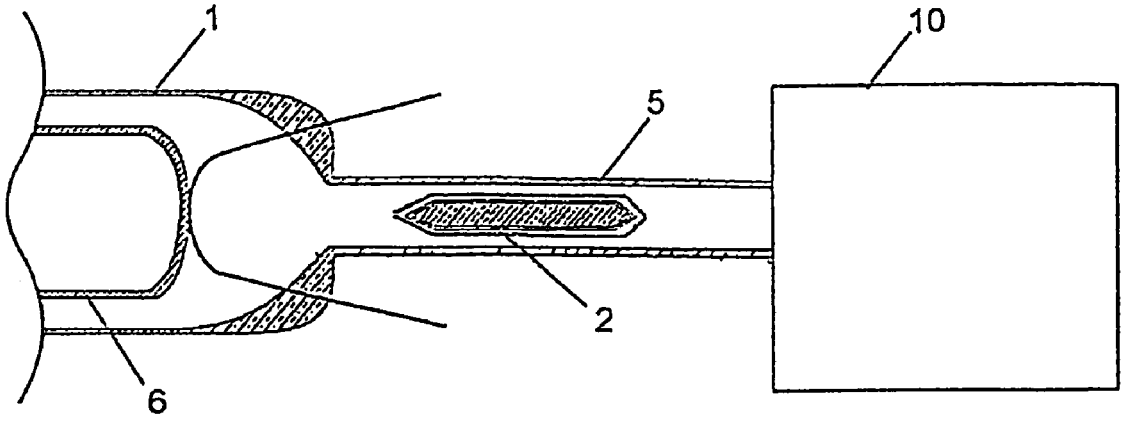
FIG. 1 is a fragmentary view of an electron lamp from the exposed electrode side, with a glass capsule containing liquid mercury and inserted into the metal container which is mounted in an exhaust tube, prior to beginning vacuum treatment of the internal space of this tube according to the invention.

As shown in FIG. 1, prior to carrying out vacuum treatment of the internal space of electron lamp 1, soldered glass capsule 2 containing liquid mercury 3 and disposed inside metal container 4, is mounted in exhaust tube 5, preferably at the end portion thereof that adjoins exposed electrode 6.

Electron lamp 1 may comprise any kind of electronic device in which fluorescence is provided by the passage of electric current through a rarefied gas (the gas discharge phenomenon).

Figure 2:
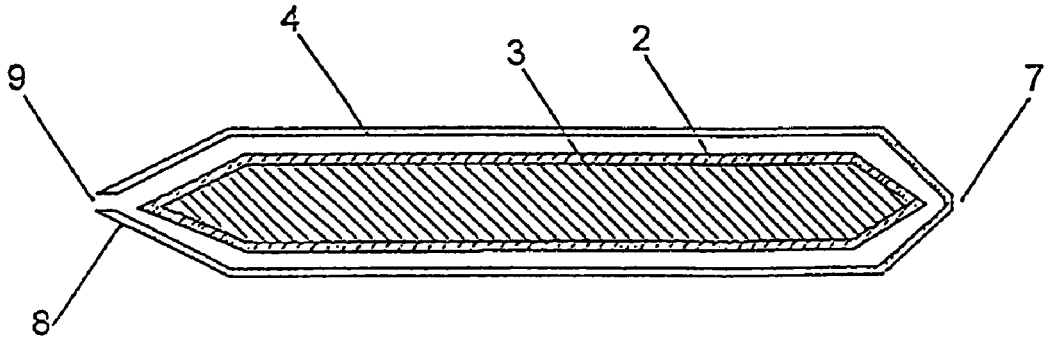
FIG. 2 is an enlarged view of a glass capsule containing liquid mercury and disposed inside a metal container.

Metal container 4 (FIG. 2) is substantially shaped as a thin-walled cylinder enclosing the glass capsule. Such container may be made of any material complying with vacuum requirements, and in particular of sheet or tube nickel. Container 4 (FIG. 2) is provided with one open end 7 and one closed end 8 having at least one opening 9 whose diameter is much less than the diameter of glass capsule 2. The diameter of opening 9 is selected to prevent ingress of glass fragments of capsule 2. Vacuum treatment comprises evacuation of air, carried out by evacuation unit 10 (FIG. 1). According to the invention, container 4 with capsule 2 is mounted in exhaust tube 5 of the exposed electrode in such position that opening 9 faces the working area of tube 1. Exhaust tube 5 is then soldered to the exhaust unit of evacuation unit 10. After vacuum treatment of the lamp, that in addition to evacuation includes washing with a gaseous mixture, glass degassing, and activation of electrodes, which provides e.g. heating up to 800-900° C. with the use of up to 500 mA current, and subsequent filling of the internal space with an inert gas, e.g. as argon or a gaseous mixture, the portion of exhaust tube 5 containing capsule 2 is separated from unit 10. Following this, said portion of exhaust tube 5 is subjected to the effect of a high-power electromagnetic radiation that causes substantially instantaneous heating of metal container 4 and destruction (explosion) of the glass capsule. When getting to the walls of container 4 (metal cylinder), mercury is subjected to substantially instantaneous evaporation, developing a sufficiently high vapor pressure, which results in the formation of a directional flow of pure (unoxidized) mercury vapor, which flow fills up the internal space of lamp 1 through opening 9. Local heating of metal container 4 may be provided by means of a laser, microwave oscillator, radio-frequency generator etc.

Figure 3:
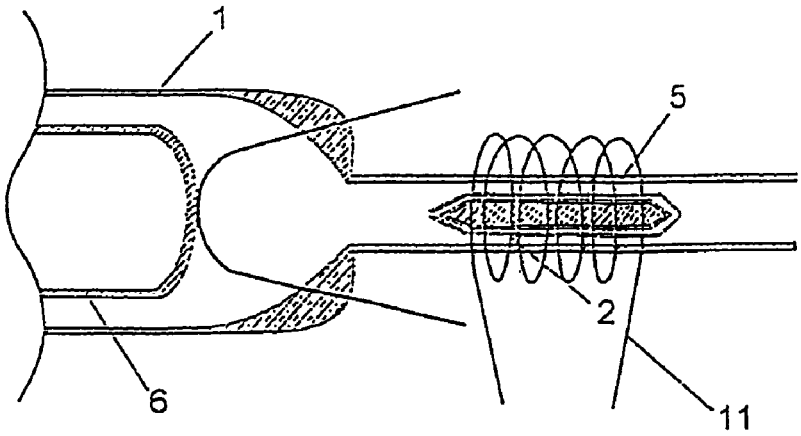
FIG. 3. is a fragmentary view of an electron lamp from the exposed electrode side, upon separation of the portion of the exhaust tube that contains the glass capsule containing liquid mercury and disposed inside a metal container, from the evacuation unit, and introduction of this portion into the inductor of a high-frequency induction heating unit of the invention.

However, the use of high-frequency induction heating should be considered preferable since this method provides a simple, reliably controllable, and safe local heating. To this end, the portion of exhaust tube 5 containing capsule 2 is inserted into inductor 11 (FIG. 3) of the high-frequency induction heating device (not shown in Figures). During high-frequency induction heating of cylindrical metal bodies, eddy currents that create their own magnetic fields, result in practically instantaneous heating of the metal container due to interaction both with one another and with the initial magnetic field. Thus, the heating time of a thin-walled metal container may be as short as 1 to 5 seconds. In the optimal embodiment of the invention, it is expedient to make use of a high-frequency induction heating device having a power rating from about 500 W to about 1 kW. Such power range permits to rapidly bring metal container temperature up to about 900-1100° C., resulting in instantaneous destruction of the glass capsule and in development of a directional flow of pure mercury vapor that fills up the internal space of lamp 1. A more prolonged impact or utilization of higher power ratings will result in undesirable heating and damage of the exhaust tube.

Upon completion of the above operations, the remaining portion of exhaust tube 5, together with metal container 4 contaminated with mercury vapor, is soldered away from the tube, and this portion turns out to be sealed inside a glass shell.

Rather promising use of the inventive method comprises manufacture of neon tubes of various patterns. The inventive method permits to establish an environmentally safe production and to carry out precise metering of introduced mercury without resorting to utilization of excessive amounts thereof, which fact finally results in substantial savings and decrease in the total consumption of mercury (approximately 10 to 15 times for neon tube products). Service life of such tubes is increased. The inventive method does not require development and installation of special electrodes in such tubes.

Given below are specific Examples of embodiment, illustrating the present invention.

It is well-known that the amount of mercury to be introduced may be calculated for each specific volume of a product to be manufactured.

For example, in the manufacture of a neon tube, its internal volume, V, is calculated from the formula:

$$V = \frac{h \cdot \pi \cdot d^2}{4}$$

where h is tube length, and d is tube internal diameter.

The calculated amount of mercury for a specific volume may be presented as one or several doses soldered inside one or several capsules. As has been stated above, for the purpose of this method the use of glass capsules containing from about 2.5 mg to about 35 mg liquid mercury is preferable. It is clear that to ensure the possibility of varying the range of doses being introduced, one or several glass capsules may be mounted inside one or several metal containers, the total contents of mercury in these containers complying with the calculated value.

EXAMPLE 1

Mercury was introduced into a neon tube of 10 mm in diameter and 1.2 m long. One glass capsule of 0.8 mm in diameter and containing 12 to 15 mg mercury was used. The capsule was placed inside a 22-mm long container made of a nickel tube of 1.25 mm in diameter and having 0.05 mm thick walls. At one end, the container was provided with an opening of about 0.6 mm in diameter. The container was mounted inside the exhaust tube in such way that the opening was disposed practically at the inlet of the tube working area.

Upon completion of the vacuum treatment, the exhaust tube with the container was soldered away from the evacuation unit, and this portion was inserted into the inductor of a radio-frequency generator having frequency rating of 1.67 MHz and power rating, of 900 W. Exposure time was 3 seconds. Following this, the remaining portion of the exhaust tube, together with the container contaminated with mercury vapor, was separated from the tube and transferred to demercuration area.

EXAMPLE 2

Mercury was introduced into a neon tube of a complicated pattern and total volume of 200 $cm^3$. Two Ni containers were mounted inside the exhaust tube close to the inlet of the tube working area, one container enclosing two glass capsules containing 15 mg mercury each, and the other container enclosing one glass capsule containing 15 mg mercury.

The technology of mercury introduction is similar to that disclosed in Example 2 except that power rating of the radio-frequency generator was 1 kW, and exposure time, 5 seconds.

EXAMPLE 3

Mercury was introduced into the bulbs of a glow discharge indicator 6 mm in diameter and 18±2 mm long.

In the automated mode used in the mass production of such indicators, exhaust tubes of each bulb were provided with Ni containers each enclosing a glass capsule containing 2.5 mg mercury, and the vacuum treatment system was connected. Exposure time of 500 W radio-frequency generator amounted to 2 to 3 seconds.

Then invention claimed is:

1. A method of introducing mercury into the internal space of an electron lamp with the use of glass capsules containing liquid mercury and disposed each within a metal container, one end of said container being provided with at least one opening whose diameter is much less than the diameter of the glass capsule, characterized in that prior to vacuum treatment at least one of said glass capsules is mounted in an exhaust tube in close proximity to an exposed electrode in such manner that the opening provided in the metal container is facing the working area of lamp tube, and upon carrying out vacuum treatment and filling the internal space with an inert gas, the portion of the exhaust tube that contains the capsule is separated from an evacuation unit, and this area is subjected to the local effect of a high-power electromagnetic radiation, thereby causing substantially instantaneous heating of the metal container, which results in a rupture of the glass capsule and intense evaporation of the liquid mercury, thereby resulting in a directional flow of pure mercury vapor, which flow rapidly fills up said internal space of the electron lamp, and the process of introduction is completed by separating the remaining portion of said exhaust tube with said metal container from said electron lamp.

2. The method as set forth in claim 1, characterized in that the amount of mercury contained in the glass capsule is within the range from about 2.5 mg to about 35 mg.

3. The method as set forth in claim 1, characterized in that the glass capsule is filled up with mercury with the use of a vacuum method.

4. The method as set forth in claim 1, characterized in that the local electromagnetic radiation is provided by a high-frequency induction heating unit having a power rating within the range from about 500 W to about 1 kW.

5. A method of introducing mercury into the internal space of a neon tube with the use of glass capsules containing liquid mercury and disposed each within a metal container, one end of said container being provided with at least one opening whose diameter is much less than the diameter of the glass capsule, characterized in that prior to vacuum treatment of the internal space of said neon tube, at least one of said glass capsules containing mercury in an amount of about 2.5 mg to about 35 mg is mounted in an exhaust tube in close proximity to an exposed electrode in such manner that the opening provided in the metal container is facing the working area of the neon tube, and upon carrying out vacuum treatment and filling the tube with an inert gas, the portion of the exhaust tube that contains the capsule is separated from an evacuation unit, and this area is placed inside an induction coil of a high-frequency induction heating unit, thereby causing a short-term induction effect at a power rating within the range from about 500 W to about 1 kW, which results in a rupture of the glass capsule and intense evaporation of the liquid mercury contained therewithin, thereby resulting in a directional flow of pure mercury vapor, which flow rapidly fills up said internal space of the tube, and the process of mercury introduction is completed by separating the remaining portion of said exhaust tube with said metal container from said neon tube.

* * * * *